US007287626B2

(12) United States Patent
Kigawa et al.

(10) Patent No.: US 7,287,626 B2
(45) **Date of Patent: *Oct. 30, 2007**

(54) BUFFER DEVICE FOR ELEVATOR

(75) Inventors: Hiroshi Kigawa, Tokyo (JP); Takashi Yumura, Tokyo (JP); Sen Zhao, Tokyo (JP); Chang-Ming Zhu, Shanghai (CN)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/451,351

(22) Filed: Jun. 13, 2006

(65) Prior Publication Data

US 2006/0231349 A1 Oct. 19, 2006

Related U.S. Application Data

(62) Division of application No. 10/441,279, filed on May 20, 2003, now abandoned.

(30) Foreign Application Priority Data

May 21, 2002 (JP) ..... 2002-146623
Mar. 5, 2003 (JP) ..... 2003-058794

(51) Int. Cl.
*B66B 5/28* (2006.01)

(52) U.S. Cl. ..... 187/344; 267/220; 267/221

(58) Field of Classification Search ..... 197/343–346, 197/351; 267/219–221, 22, 227; 187/343–345, 187/351

See application file for complete search history.

(56) References Cited

U.S. PATENT DOCUMENTS 986,378 A 3/1911 Furlow
1,136,678 A 4/1915 Jansson
1,873,807 A 8/1932 Arnold
2,744,587 A 5/1956 Beck
2,974,943 A 3/1961 Ames
3,559,976 A * 2/1971 Jerz, Jr. ..... 267/290
3,857,555 A 12/1974 Mori et al.
3,868,912 A 3/1975 Wagner et al.
3,874,307 A * 4/1975 Schwam ..... 105/198.3
3,889,934 A 6/1975 Kamman
4,015,835 A 4/1977 Schumacher et al.
4,162,062 A * 7/1979 Strauss ..... 267/225
4,235,317 A 11/1980 Maciejewski
4,361,209 A 11/1982 Kappenhagen et al.

(Continued)

FOREIGN PATENT DOCUMENTS

CN 2487716 Y 4/2002

(Continued)

*Primary Examiner*—Thomas J. Brahan
(74) *Attorney, Agent, or Firm*—Leydig, Voit & Mayer, Ltd.

(57) ABSTRACT

In a buffer device for an elevator, a hydraulic buffer that alleviates shock generated when a traveling body impacts at the bottom of a hoistway is located at the bottom of the hostway. Provided between the traveling body and the bottom of the hoistway is an elastic member that is elastically deformed and that alleviates the shock generated by the impact of the traveling body with the hydraulic buffer. The elastic member is arranged so that, when elastically deformed, almost fall of the elastic member is positioned within a range of a vertical dimension of the hydraulic buffer.

3 Claims, 18 Drawing Sheets

U.S. PATENT DOCUMENTS

| | | | | |
|---|---|---|---|---|
| 4,396,098 | A * | 8/1983 | Petrak | 188/280 |
| 4,515,248 | A | 5/1985 | Ohta | |
| 4,635,907 | A | 1/1987 | Bialy et al. | |
| 4,735,291 | A * | 4/1988 | Kappenhagen | 187/272 |
| 4,848,519 | A | 7/1989 | Ericson et al. | |
| 5,181,697 | A | 1/1993 | Rumer | |
| 5,195,616 | A | 3/1993 | Yoo et al. | |
| 5,244,190 | A * | 9/1993 | Bianchi | 267/195 |
| 5,513,724 | A | 5/1996 | De Jong | |
| 6,327,024 | B1 | 12/2001 | Hayashi et al. | |

FOREIGN PATENT DOCUMENTS

| | | |
|---|---|---|
| DE | 100 25 755 | 11/2001 |
| JP | 54-97951 | 8/1979 |
| JP | 60-137766 (U) | 9/1985 |
| JP | 3-51282 | 3/1991 |
| JP | 3-95086 | 4/1991 |
| JP | 3-120182 | 5/1991 |
| JP | 4-201965 | 7/1992 |
| JP | 4-217577 | 8/1992 |
| JP | 5-139654 | 6/1993 |
| JP | 5-246647 | 9/1993 |
| JP | 6-234477 | 8/1994 |
| JP | 11-107503 | 4/1999 |
| JP | 2001-240338 | 9/2001 |
| JP | 2001-241506 | 9/2001 |

* cited by examiner

BUFFER DEVICE FOR ELEVATOR

BACKGROUND OF THE INVENTION

1. Field of the Invention

The present invention relates to a buffer device for an elevator that uses a hydraulic buffer for alleviating shock generated when a traveling (ascending/descending) body impacts the bottom of a hoistway.

2. Description of the Related Art

FIG. 18 is a construction diagram showing an example of a conventional elevator. In the upper portion of a hoistway 1, there is a hoisting machine 3 having a driving sheave 2 and a deflector sheave 4, and a main rope (hoisting rope) 5 is wrapped around the driving sheave 2 and the deflector sheave 4. From one end portion of the main rope 5, a car 6 as a traveling body is suspended. From the other end portion of the main rope 5, a counterweight 7 that is another traveling body is suspended. Normally, the weight of the counterweight 7 is set so as to be equal to the sum of the own weight of the car 6 per se and 50% of the rated load capacity of the car 6.

At the bottom (pit) of the hoistway 1, a car buffer 8 and a counterweight buffer 9 are installed. The car buffer 8 and the counterweight buffer 9 alleviate shock generated when the car 6 or the counterweight 7 collide with the bottom of the hoistway 1. Although the car buffer 8 and the counterweight buffer 9 can be broadly classified into spring buffers and hydraulic buffers, if the rated speed of an elevator is equal to 90 m/minor more, a hydraulic buffer is used for the elevator.

FIG. 19 is a front view showing an example of a conventional hydraulic buffer. On an attachment base 11, a cylinder 12 filled with oil is provided. Into this cylinder 12, there is inserted a cylindrical plunger 13 that is capable of reciprocating in an axial direction. On the upper end portion of the cylinder 12, a flange 14 is fixed. On the upper end portion of the plunger 13, a spring bracket 15 is fixed.

Between the flange 14 and the spring bracket 15, there is arranged a return spring 16 that urges the plunger 13 in a direction (upward direction) in which the plunger 13 protrudes from the cylinder 12. In order to avoid a metal-to-metal impact that occurs when the car 6 or the counterweight 7 impacts the hydraulic buffer, a buffer member 17 is provided on the spring bracket 15.

FIG. 20 is a cross-sectional view that schematically shows the internal construction of the hydraulic buffer in FIG. 19. In the lower portion of the plunger 13, an orifice 18 is provided. In the cylinder 12, a control rod 19 is fixed. The control rod 19 is inserted into the plunger 13 from the orifice 18 when the plunger 13 is moved downward.

Also, the diameter of the control rod 19 is changed in the axial direction (vertical direction). Consequently, the clearance area between the orifice 18 and the control rod 19 changes in accordance with the amount of displacement of the plunger 13. That is, the diameter of the control rod 19 gradually increases in a downward direction and, when the amount of downward displacement of the plunger 13 increases, the clearance between the orifice 18 and the control rod 19 is narrowed. As a result, a reaction force generated by hydraulic pressure acts on the plunger 13 and the impacting car 6 or counterweight 7 is decelerated.

The hydraulic buffer is designed so that when the car 6 collides at a speed that is 1.15 times faster than the rated speed, the car 6 is decelerated at a predetermined rate and is stopped with safety. As a result, in accordance with increases in the rated speed, the stroke of the plunger 13 is elongated and therefore the height of the hydraulic buffer is increased.

If the height of the hydraulic buffer is increased as described above, the depth of a pit in which the hydraulic buffer is contained is also increased. In view of this problem, for the sake of reducing pit depth, it is permitted by US rules (ASME 17.1a-1997 Rule 201.4h) that a part of the plunger 13 can be positioned in the traveling path of the car 6 during normal operation. That is, under this US rule, when the car 6 lands at the lowest floor, the car 6 is allowed to displace within a range of ¼ or less of the whole stroke of the plunger 13.

In this case, each time the car 6 lands at the lowest floor during normal operation, the car 6 impacts the hydraulic buffer. However, the speed, at which the car 6 impacts the hydraulic buffer during normal operation, becomes considerably lower than a speed at the time when the hydraulic buffer functions as a safety apparatus, so that the level of shock is also reduced.

FIG. 21 is a cross-sectional view showing a main portion of another example of a conventional hydraulic buffer. In this example, on the upper end portion of the plunger 13, there are mounted a buffer member 21 and an auxiliary buffer 22. The auxiliary buffer 22 includes a cylinder 23, a piston rod 24 inserted into the cylinder 23, a piston 25 that is fixed on the tip portion of the piston rod 24 and is made to slide within the cylinder 23, a supporting plate 26 that is fixed on the base end portion of the piston rod 24 and is coupled to the upper end portion of the buffer member 21, and a free piston 27 that is arranged within the cylinder 23.

Between the piston 25 and the free piston 27 within the cylinder 23, there is formed a lower portion oil chamber 28. Above the piston 25 within the cylinder 23, there is formed an upper portion oil chamber 29. Below the free piston 27 within the cylinder 23, there is formed a gas chamber 30. The piston 25 is provided with a check valve 31 and an orifice 32 (see JP 2001-241506 A, for instance).

In a hydraulic buffer like this, when there is an impact of a car 6, the buffer member 21 is compressed and the piston rod 24 is displaced downward. Following this, the buffer member 21 tries to restore its initial state in a decompression direction, although rapid restoration of the buffer member 21 is prevented by the auxiliary buffer 22. As a result, vibration of the buffer member 21 is prevented and therefore a situation where a passenger in the car 6 feels discomfort due to the vibration can be avoided.

In the conventional hydraulic buffer constructed in the manner described above, as a material of the buffer member 17, there is selected a material that possess high stiffness which is able to stand the weight of the car 6 and the reaction force of hydraulic pressure from the plunger 13. Therefore, when the car 6 impacts the hydraulic buffer, shock and noise are generated. In particular, in elevators where the car 6 impacts the hydraulic buffer even during normal operation, there is a danger that a passenger will feel discomfort due to the shock and noise generated by the impact.

It is possible to alleviate such shock and noise to some extent by making the buffer member 17 thick and soft, although if the thickness of the buffer member 17 is increased, the height of the buffer under a compressed state is also increased accordingly, which leads to a situation where the depth (pit depth) from the bottom surface of the car 6 to the bottom of the hoistway 1 when the car 6 is positioned at the lowest floor is increased.

Also, in cases where the auxiliary buffer 22 shown in FIG. 21 is provided, the pit depth is increased because the auxiliary buffer 22 is thick. Further, the auxiliary buffer 22 is provided to suppress the vibration of the buffer member 21, so that the shock at the time of impact with the buffer member 21 is not sufficiently alleviated.

SUMMARY OF THE INVENTION

The present invention has been made in order to solve the problems described above, and has an object to provide a buffer device for an elevator, with which it is possible to reduce, without increasing pit depth, shock and noise generated when a car impacts a hydraulic buffer.

To this end, in a buffer device for an elevator according to one aspect of the present invention, an elastic member is provided between a traveling body and a bottom of a hoistway. The elastic member is elastically deformed to thereby alleviate shock generated by impact of the traveling body with a hydraulic buffer. The elastic member is arranged so that when elastically deformed, almost the whole thereof is positioned within a range of a vertical dimension of the hydraulic buffer. Accordingly, it becomes possible to reduce shock and noise generated when the traveling body impacts the hydraulic buffer.

DETAILED DESCRIPTION OF THE PREFERRED EMBODIMENTS

Preferred embodiments of the present invention will now be described with reference to the accompanying drawings.

First Embodiment

Figure 1:
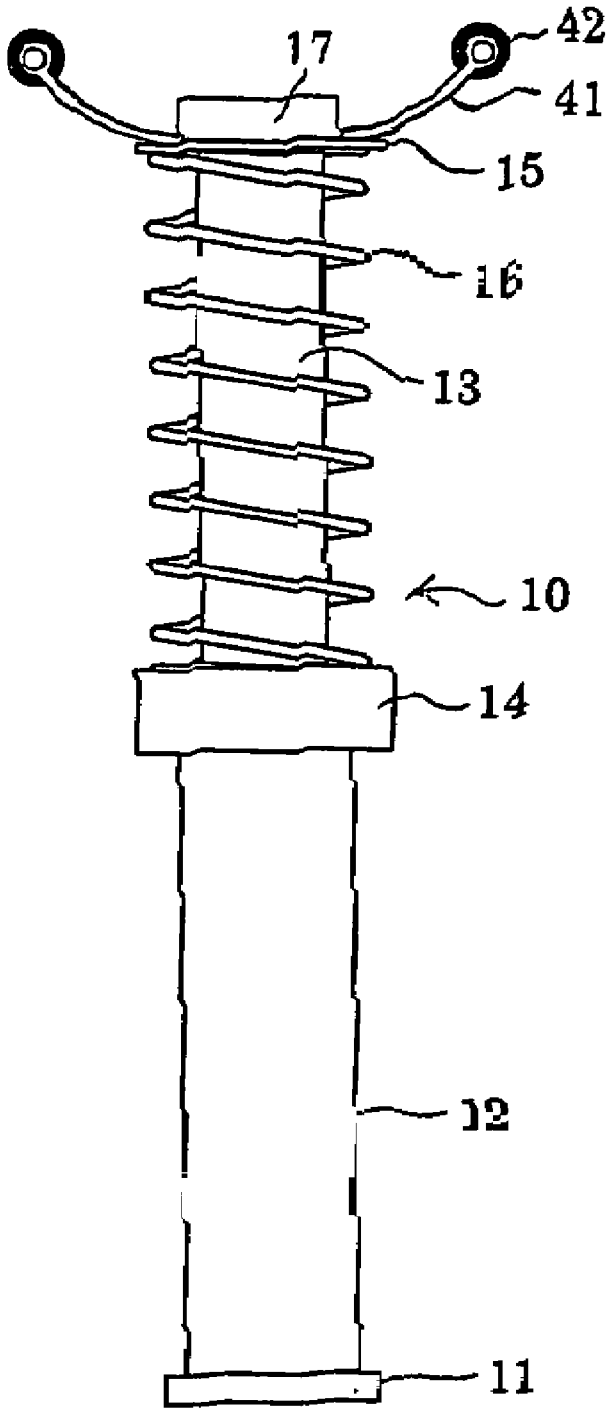
FIG. 1 is a front view showing a buffer device for an elevator according to a first embodiment of the present invention.

FIG. 1 is a front view showing a buffer device for an elevator according to a first embodiment of the present invention. In this drawing, on an attachment base 11, a cylinder 12 filled with oil is provided. Into this cylinder 12, there is inserted a cylindrical plunger 13 that is capable of reciprocating in an axial direction. On the upper end of the cylinder 12, a flange 14 is fixed. On the upper end portion of the plunger 13, a spring bracket 15 is fixed.

Between the flange 14 and the spring bracket 15, there is arranged a return spring 16 that urges the plunger 13 in a direction (upward direction) in which the plunger 13 protrudes from the cylinder 12. In order to avoid a metal-to-metal impact that occurs when a car 6 or a counterweight 7 impacts a hydraulic buffer, a buffer member 17 is provided on the spring bracket 15.

Figure 20:
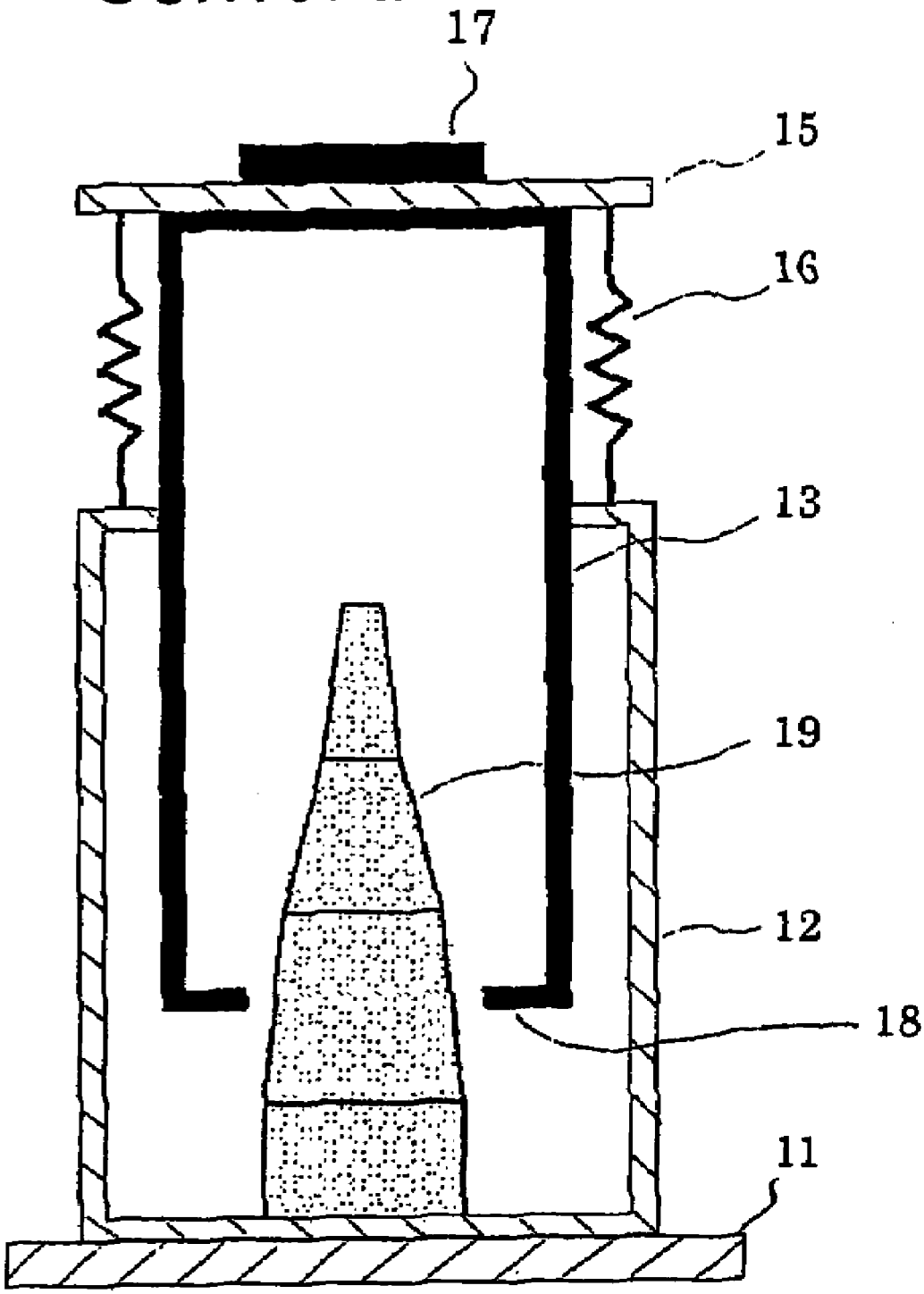
FIG. 20 Conventional Art
FIG. 20 is a cross-sectional view that schematically shows an internal construction of the hydraulic buffer in FIG. 19.
Figure 21:
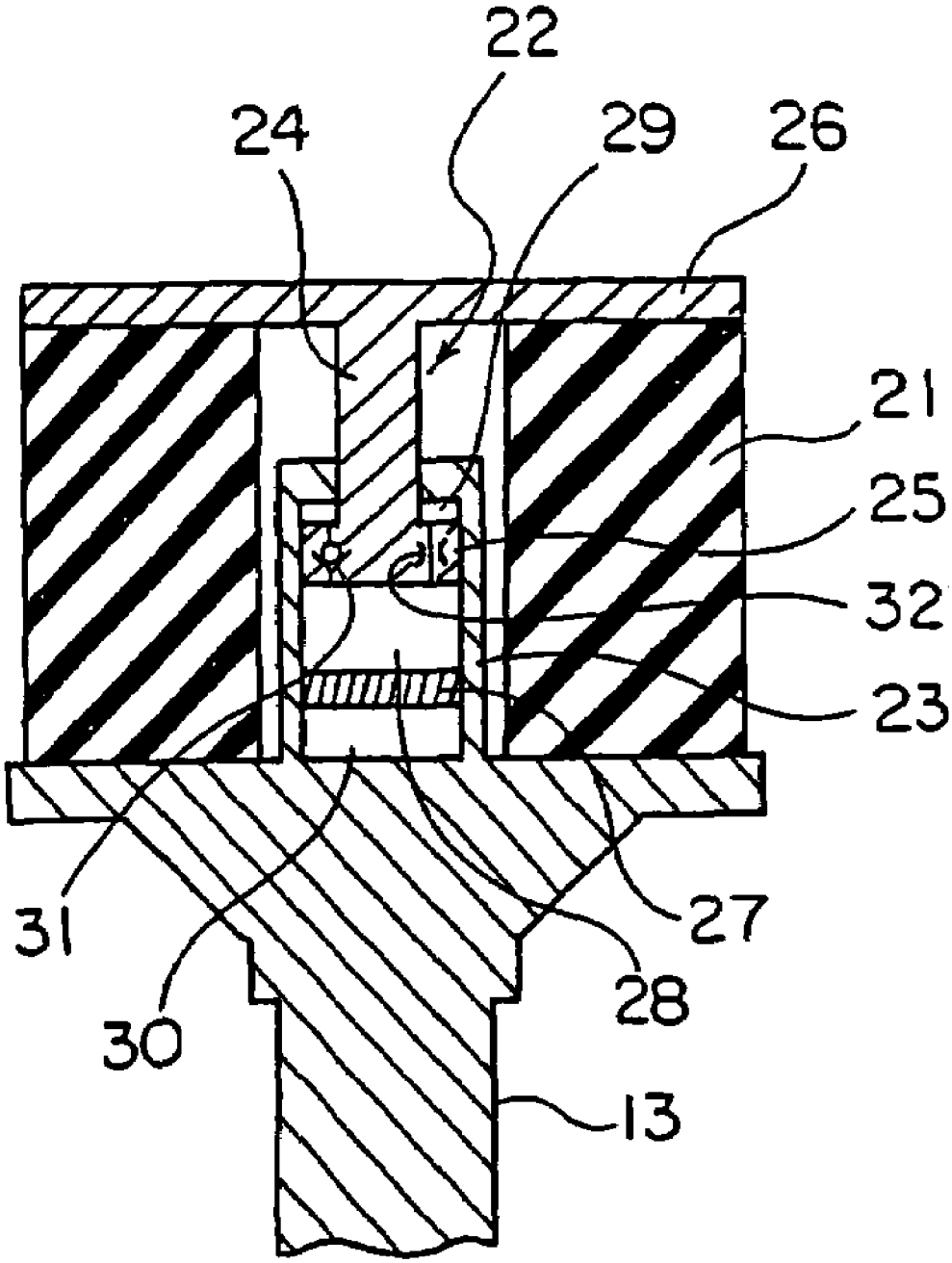
FIG. 21 Conventional Art
FIG. 21 is a cross-sectional view showing a main portion of another example of the conventional hydraulic buffer.

A hydraulic buffer 10 is composed of the attachment base 11, the cylinder 12, the plunger 13, the flange 14, the spring bracket 15, the return spring 16, and the buffer member 17. Also, the internal construction of the hydraulic buffer 10 is the same as that shown in FIG. 20.

On the spring bracket 15 of the hydraulic buffer 10, a leaf spring 41 is attached as an elastic member. In the upper end portions of the leaf spring 41, there are provided a plurality of rollers 42 that are capable of freely rotating. Each roller 42 is made of a buffer material such as rubber, nylon, or a urethane resin.

Figure 18:
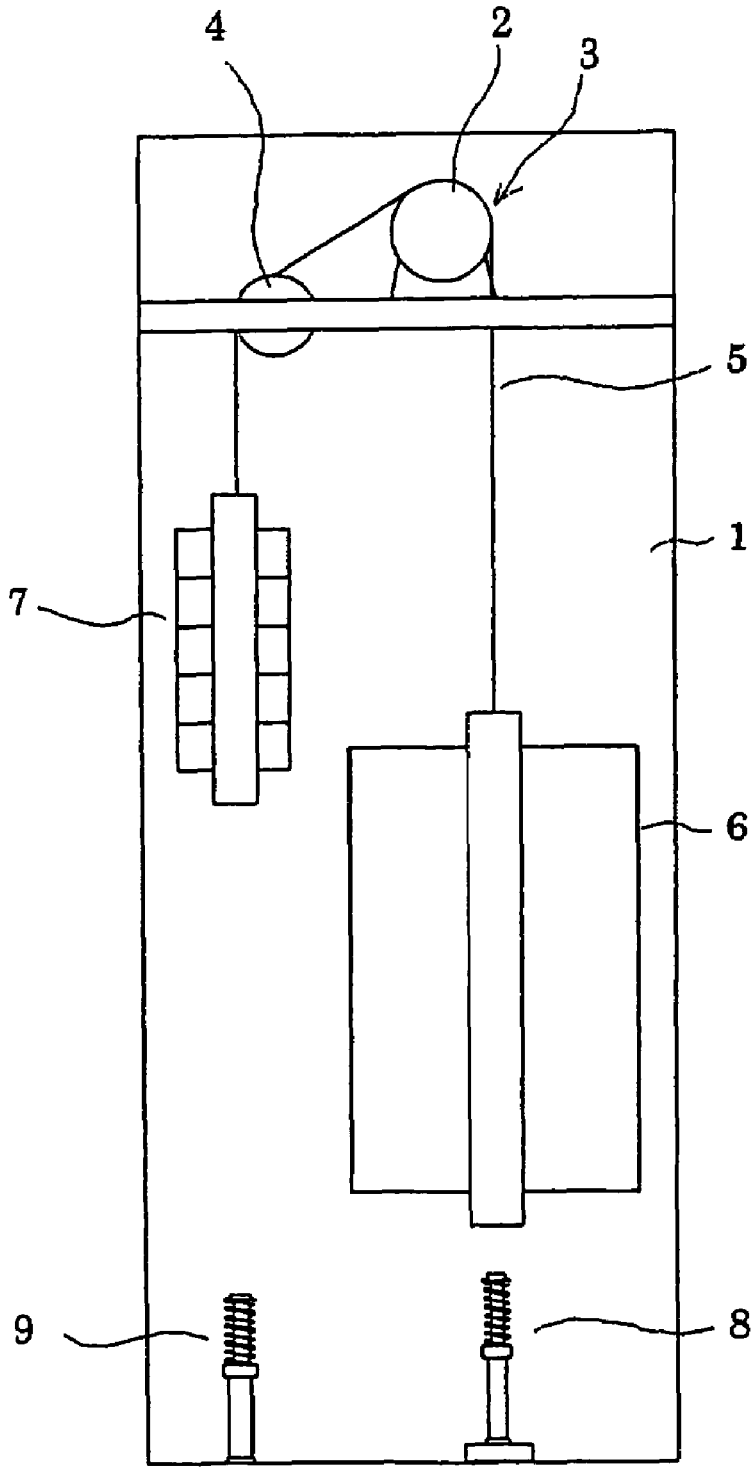
FIG. 18 Conventional Art
FIG. 18 is a construction diagram showing an example of a conventional elevator.
Figure 19:
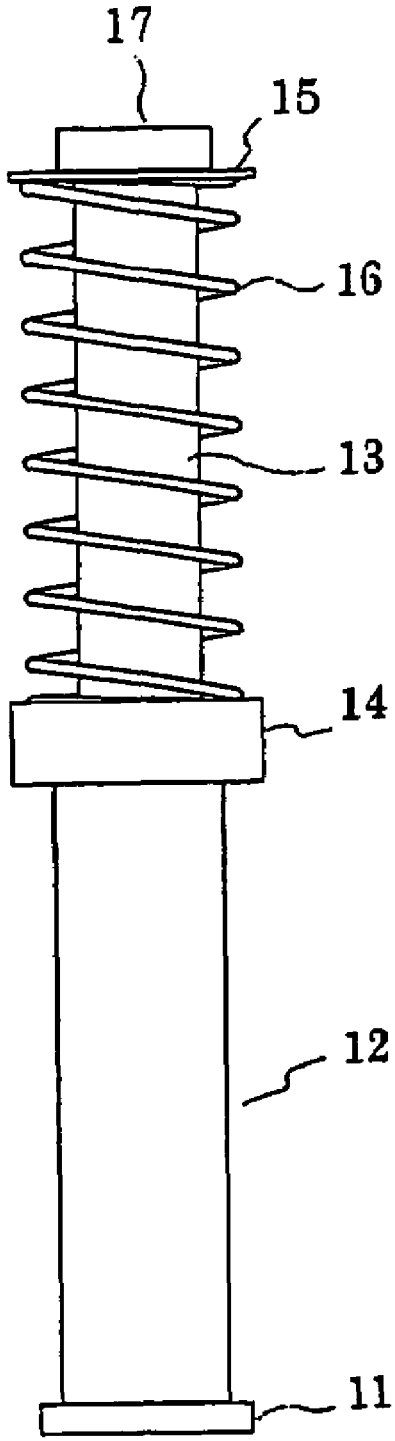
FIG. 19 Conventional Art
FIG. 19 is a front view showing an example of a conventional hydraulic buffer.

Also, the upper end portions of the leaf spring 41 are positioned higher than the upper end portion of the hydraulic buffer 10, so that the leaf spring 41 is always deformed before the hydraulic buffer 10 is compressed. In other words, the leaf spring 41 is arranged between the hydraulic buffer 10 and the car 6 or the counterweight 7 (see FIG. 18).

Figure 2:
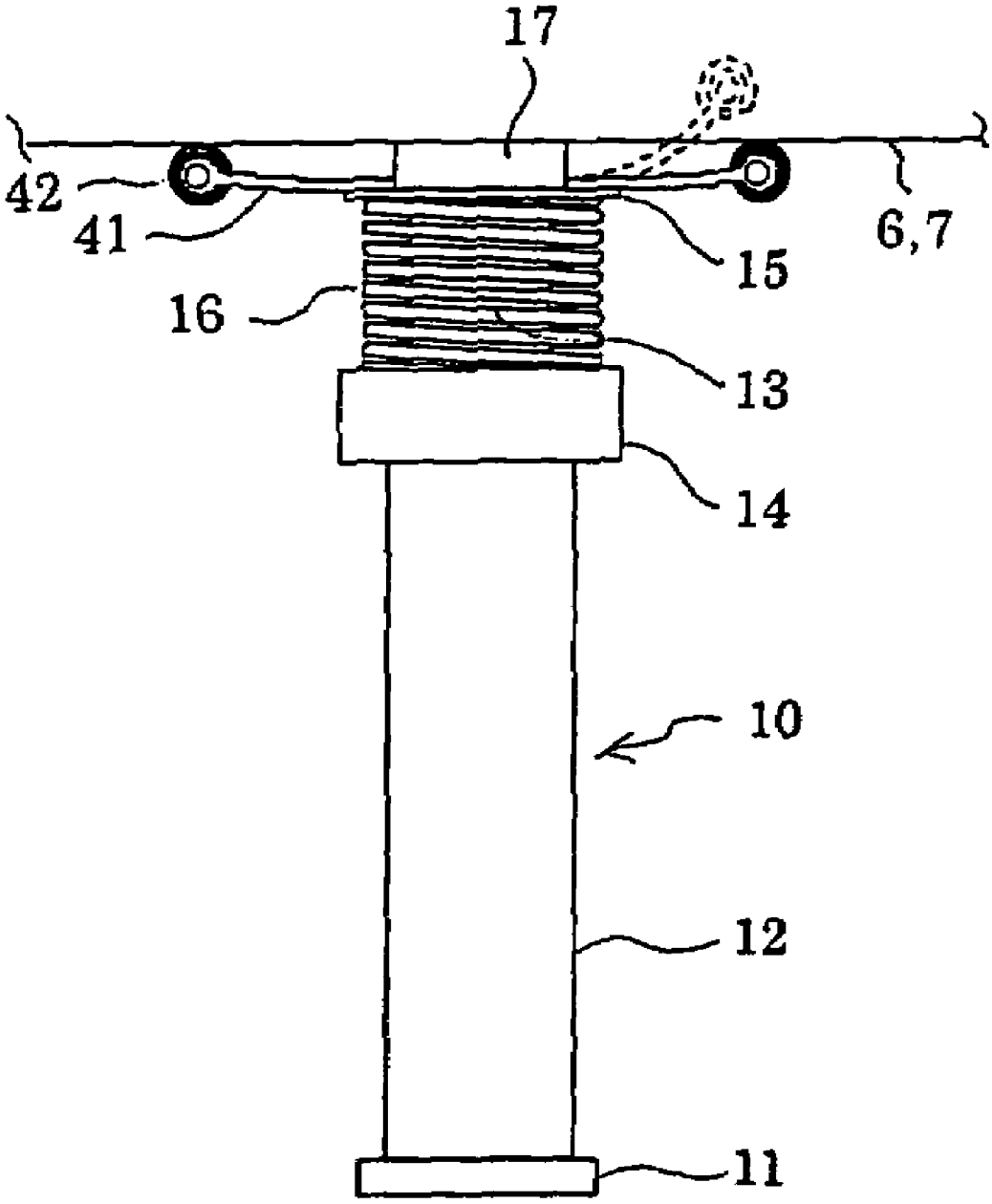
FIG. 2 is a front view showing a state where the buffer device in FIG. 1 is compressed.

FIG. 2 is a front view showing a state where the buffer device in FIG. 1 is compressed. When the leaf spring 41 is elastically deformed by an impact with the car 6 or the counterweight 7, the leaf spring 41 is wholly positioned within the range of a dimension in a vertical direction of the hydraulic buffer 10. Also, the stiffness of the leaf spring 41 is set lower than the stiffness of the buffer member 17. Further, the leaf spring 41 is constructed so as not to exceed its elastic region due to the compressive force of the plunger 13 when the car 6 or the counterweight 7 impacts the hydraulic buffer 10.

Next, there will be described an operation in this embodiment. When the car 6 or the counterweight 7 impacts the buffer device, the lower portion of the car 6 first abuts against the rollers 42, so that the leaf spring 41 is elastically deformed. In accordance with the deformation of the leaf spring 41, the rollers 42 move in a right-left direction in the drawing while contacting and rolling on the bottom surface of the car 6 or the counterweight 7.

Shock energy immediately after the impact of the car 6 or the counterweight 7 is absorbed by the minute deformation and rolling friction of the rollers 42 and the deformation of the leaf spring 41, so that impact noise is also reduced. Following this, the plunger 13 is displaced downward and hydraulic braking is applied by the hydraulic buffer 10. As a result, the car 6 or the counterweight 7 is decelerated and stopped with safety.

With a buffer device like this, it becomes possible to reduce shock and noise generated when the car 6 or the counterweight 7 impacts the hydraulic buffer 10 using the deformation of the leaf spring 41. Also, under a state where the hydraulic buffer 10 is compressed, the bottom surface of the car 6 or the counterweight 7 directly contacts the buffer member 17 of the hydraulic buffer 10. As a result, it becomes possible to disregard the dimensions in a vertical direction of the elastic member 41 and the rollers 42, which saves the necessity to increase the pit depth.

Also, it is preferable that the buffer device having such a construction is designed so that there is no contact of the car 6 and the buffer member 17 at an initial stage of the impact at which the car speed is not sufficiently decelerated. That is, it is preferable that the spring constant of the leaf spring 41 is set so that the plunger 13 starts to move downward after the leaf spring 41 is deformed to some extent and before the car 6 impacts the buffer member 17.

In order to have the plunger 13 move downward before the car 6 impacts the buffer member 17, it is required to increase the spring constant of the leaf spring 41. However, in order to reduce the shock and noise generated by the impact immediately after the leaf spring 41 starts to be deformed, the spring constant must be reduced.

The spring constant of an ordinary linear spring does not vary with reference to displacement, so that it is difficult to satisfy both of the conditions described above. In contrast to this, in the case of a non-linear spring having a spring constant shown in FIG. 3, it is possible to satisfy both of the conditions. That is, by using the non-linear spring, it becomes possible to obtain a small spring constant when displacement is small and to increase the spring constant in accordance with an increase in the displacement amount.

In the case where such a non-linear spring is used as the leaf spring 41, the spring exhibits a small spring constant immediately after the impact of the car 6, so that it becomes possible to effectively reduce shock and noise generated by the impact. Also, the spring constant is suddenly increased in accordance with an increase in displacement amount, so that it also becomes possible to allow the plunger 13 to move downward before the car 6 impacts the buffer member 17.

Further, it is possible not only to alleviate the shock immediately after the impact but also to omit the buffer member 17, which makes it possible to further reduce the top-bottom size of the hydraulic buffer 10 in a compressed state. Note that the non-linear leaf spring can be obtained by stacking several leaf springs having different curvatures on each other, for instance. That is, it is sufficient that there is obtained a construction where the leaf spring having the higher curvature first starts to act. With this construction, the stiffness is gradually increased in accordance with an increase in bending degree of the springs.

Second Embodiment

Figure 4:
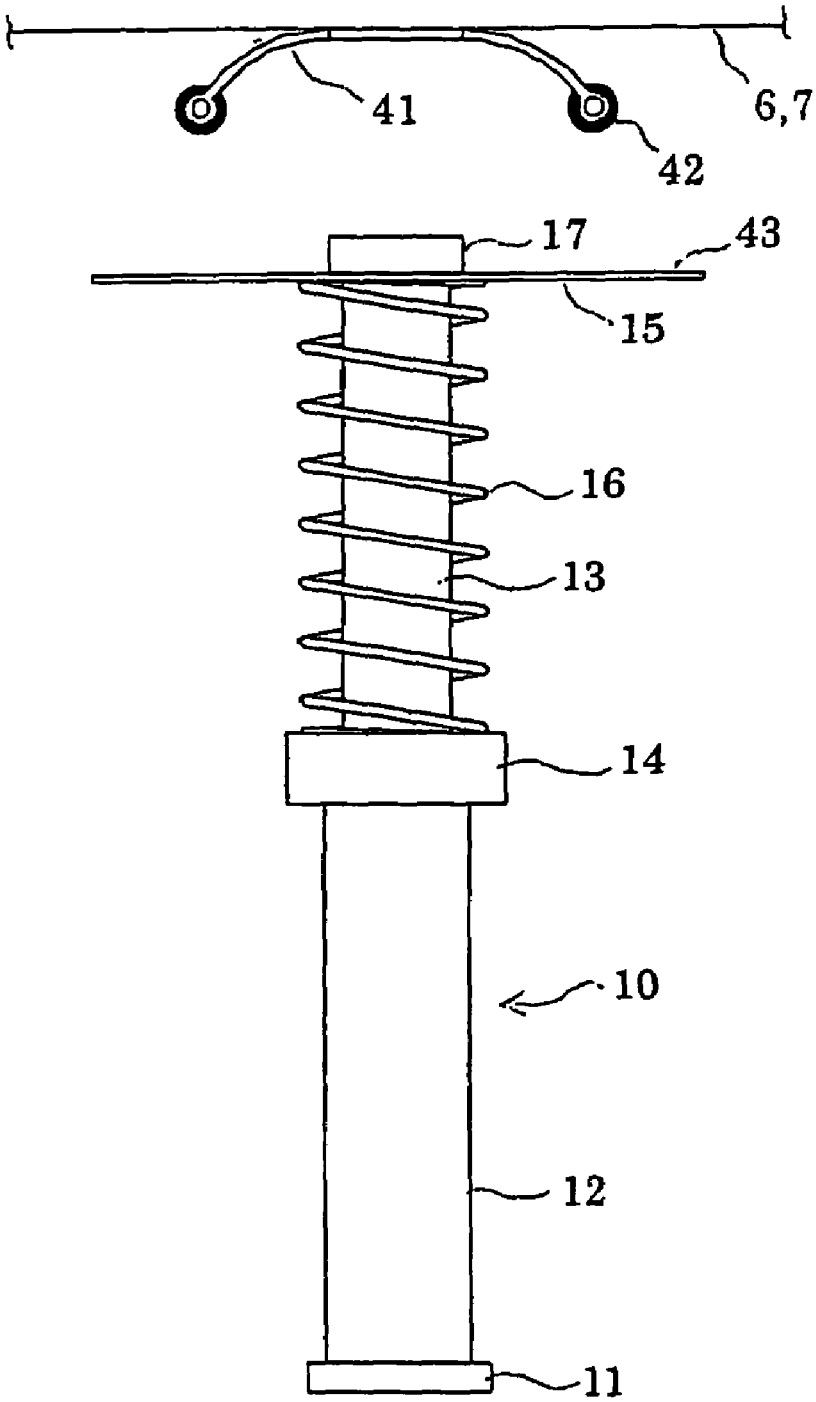
FIG. 4 is a front view showing a buffer device for an elevator according to a second embodiment of the present invention.

FIG. 4 is a front view showing a buffer device for an elevator according to a second embodiment of the present invention. In this embodiment, the leaf spring 41 is mounted on the lower portion of the car 6 or the counterweight 7. In the lower end portion of the leaf spring 41, there are provided a plurality of rollers 42. On the upper portion of the hydraulic buffer 10, there is horizontally fixed an abutment portion 43 against which the rollers 42 are to be abutted. This abutment portion 43 is formed by extending the spring bracket 15. Other constructions are the same as those in the first embodiment.

Even in the case where the leaf spring 41 is mounted on the car 6 side or the counterweight 7 side in the manner described above, it is possible to reduce, without increasing the pit depth, shock and noise generated when the car 6 or the counterweight 7 impacts the hydraulic buffer 10.

Third Embodiment

Figure 5:
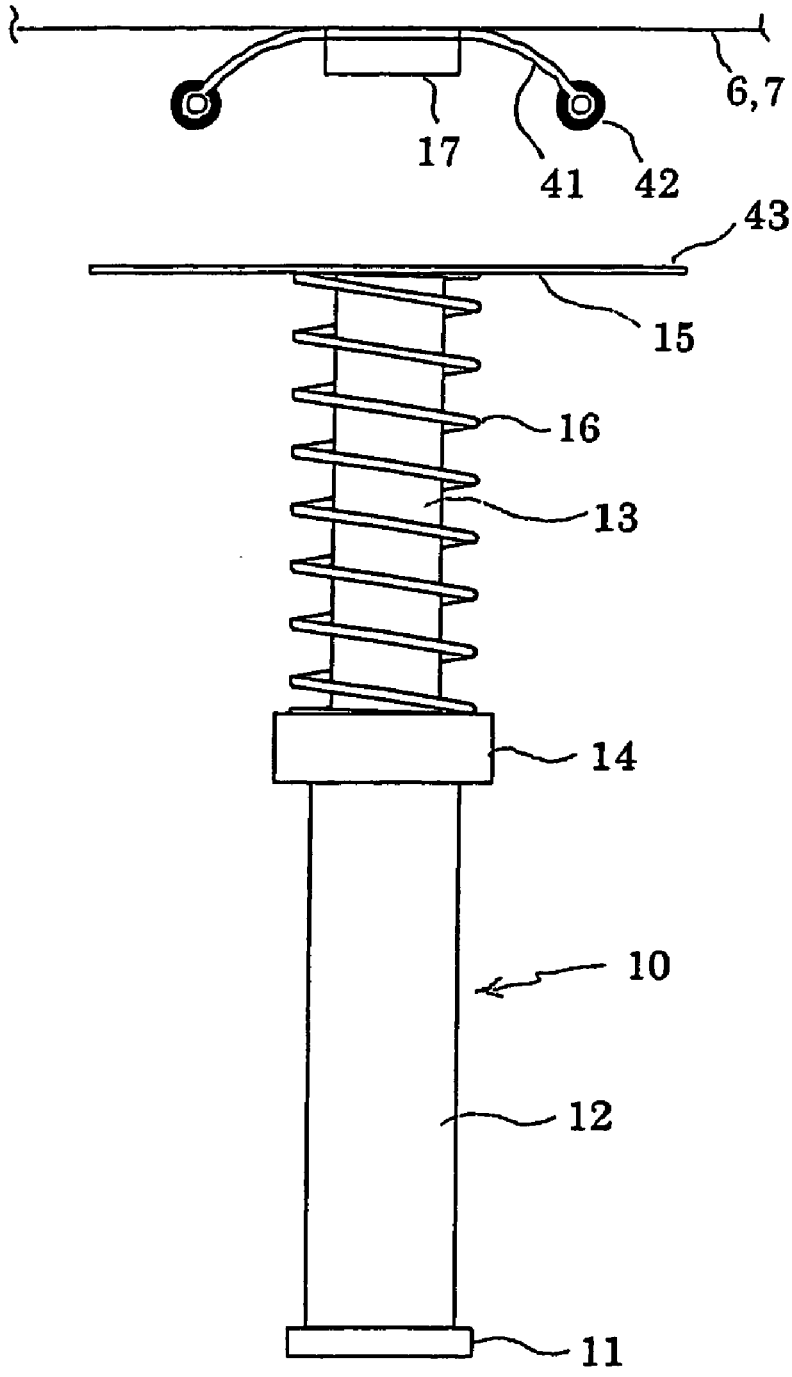
FIG. 5 is a front view showing a buffer device for an elevator according to a third embodiment of the present invention.

FIG. 5 is a front view showing a buffer device for an elevator according to a third embodiment of the present invention. In this embodiment, the buffer member 17 is mounted on the car 6 side or the counterweight 7 side. Other constructions are the same as those in the second embodiment. No problem occurs even if the buffer member 17 is mounted on the car 6 side or the counterweight 7 side in this manner.

Fourth Embodiment

Figure 6:
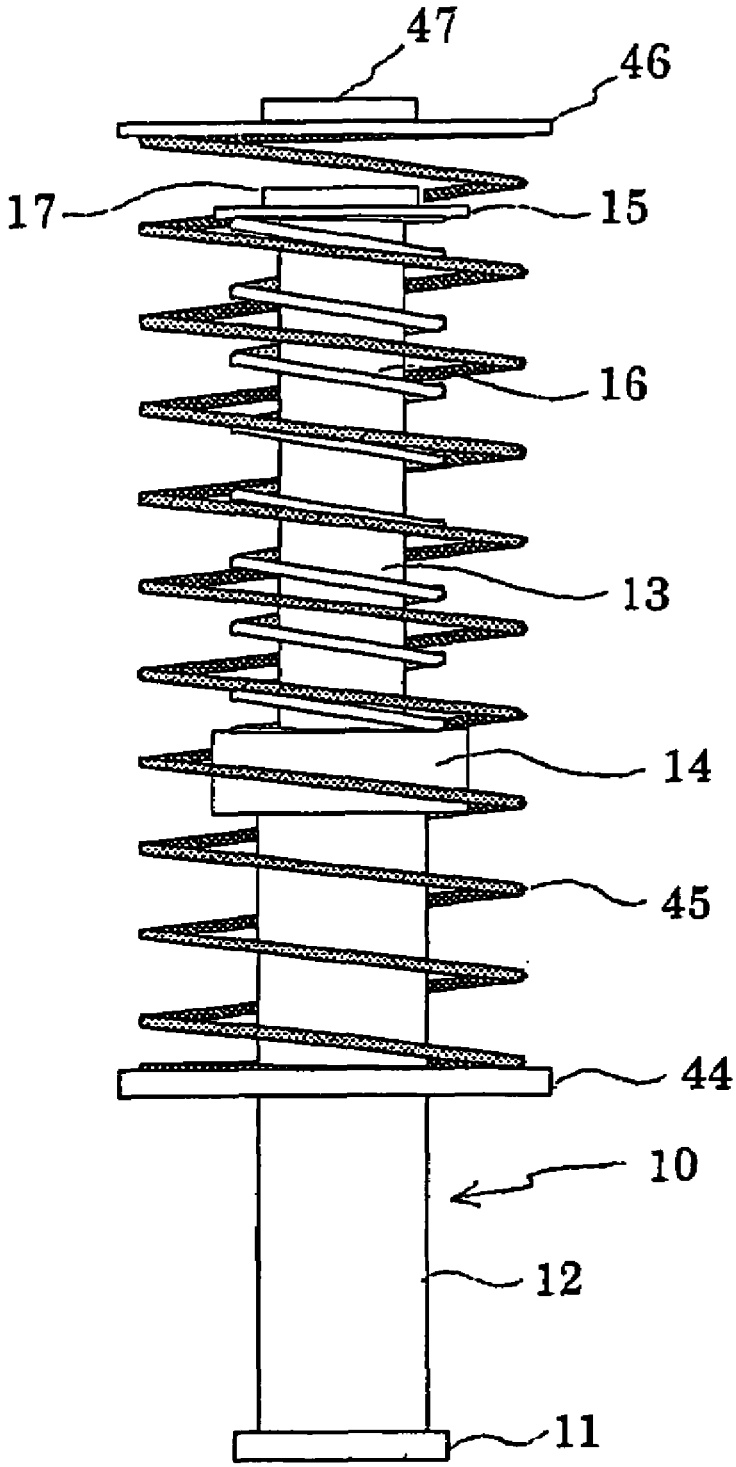
FIG. 6 is a front view showing a buffer device for an elevator according to a fourth embodiment of the present invention.

FIG. 6 is a front view showing a buffer device for an elevator according to a fourth embodiment of the present invention. In this drawing, in the midpoint portion of the cylinder 12, a fixed spring bracket 44 is horizontally fixed. On the fixed spring bracket 44, a parallel spring 45 that is an elastic member is supported. The parallel spring 45 is a coil spring that is arranged in parallel to the hydraulic buffer 10. Also, the parallel spring 45 is arranged so as to surround a part of the hydraulic buffer 10.

On the upper end portion of the parallel spring 45, there is horizontally fixed a flat-plate-shaped movable spring bracket 46 that is to be vertically moved by expansion and contraction of the parallel spring 45. The upper end portion of the parallel spring 45 is positioned higher than the upper end portion of the hydraulic buffer 10. As a result, the movable spring bracket 46 is arranged higher than the upper end portion of the hydraulic buffer 10. On the movable spring bracket 46, there is fixed a buffer member 47. Also, the stiffness of the parallel spring 45 is set lower than the stiffness of the buffer member 17. Further, the parallel spring 45 is constructed so as not to exceed its elastic region even when the car 6 or the counterweight 7 impacts the hydraulic buffer 10 and the parallel spring 45 is compressed.

Next, there will be described an operation in this embodiment. When the car 6 or the counterweight 7 impacts the buffer device, the lower portion of the car 6 or the counterweight 7 first strikes against the buffer member 47, so that the buffer member 47 is elastically deformed. Following this, the buffer member 47 and the movable spring bracket 46 are pushed down, so that the parallel spring 45 is compressed (elastically deformed).

Shock energy immediately after the impact of the car 6 or the counterweight 7 is absorbed by the minute deformation of the buffer member 47 and the deformation of the parallel spring 45. As a result, there is also reduced impact noise. Following this, the plunger 13 is displaced downward and hydraulic braking is applied by the hydraulic buffer 10. As a result, the car 6 or the counterweight 7 is decelerated and stopped with safety.

With a buffer device like this, it becomes possible to reduce shock and noise generated when the car 6 or the counterweight 7 impacts the hydraulic buffer 10 using the deformation of the parallel spring 45. Also, the shock energy is absorbed by the parallel spring 45, so that it becomes possible to reduce the thickness of the buffer member 17 in comparison with the conventional case. As a result, it also becomes possible to set the total thickness of the two buffer members 17 and 47 as equal to or less than the thickness of one conventional buffer member. Accordingly, under a state where the buffer device is compressed, the height of the hydraulic buffer 10 becomes larger by only the thickness of the movable spring bracket 46 and this thickness is negligible, so that it is unnecessary to increase the pit depth.

Figure 3:
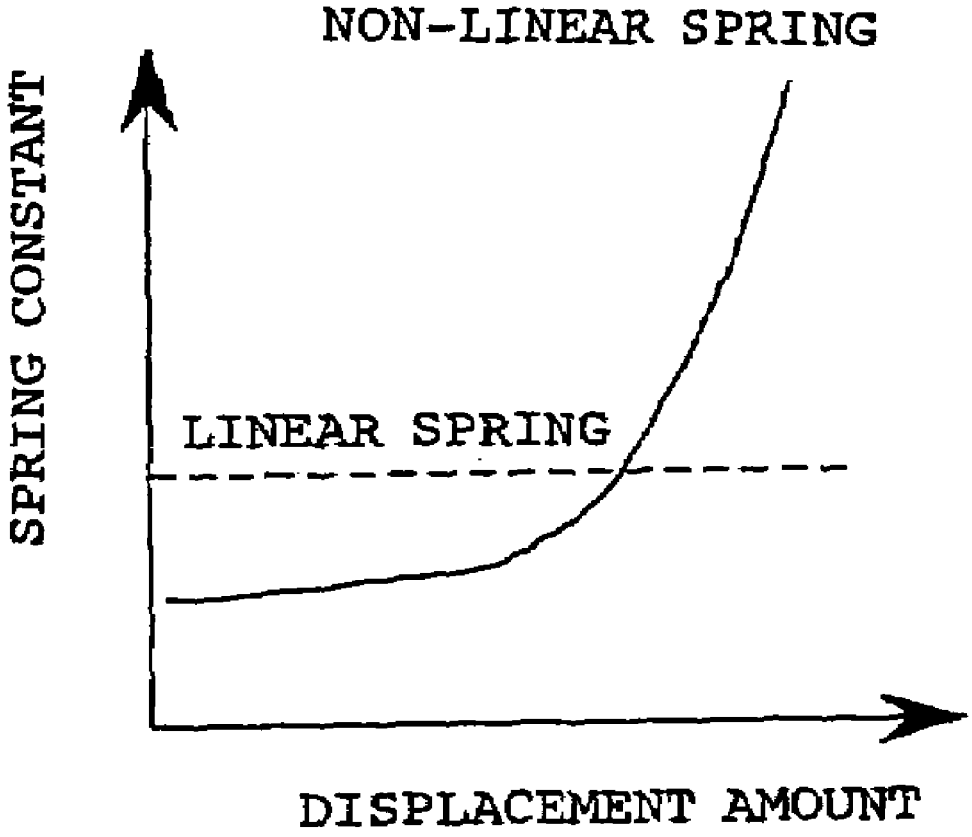
FIG. 3 is a graph showing spring constants of a linear spring and a non-linear spring.

In the fourth embodiment, for the same reason as in the first embodiment, it is suitable that a non-linear spring having the spring constant shown in FIG. 3 is used as the parallel spring 45. This non-linear coil spring is obtained by, for instance, successively changing the diameter of a wire constituting the coil in a tapered manner or making the inter-wire pitch of the coil spring uneven.

It should be noted here that at least one of the buffer members 17 or 47 may be omitted.

Also, in the embodiment described above, the parallel spring 45 is arranged so as to surround a part of the hydraulic buffer 10, although the parallel spring 45 may be arranged so as to be separated from the hydraulic buffer 10.

Fifth Embodiment

Figure 7:
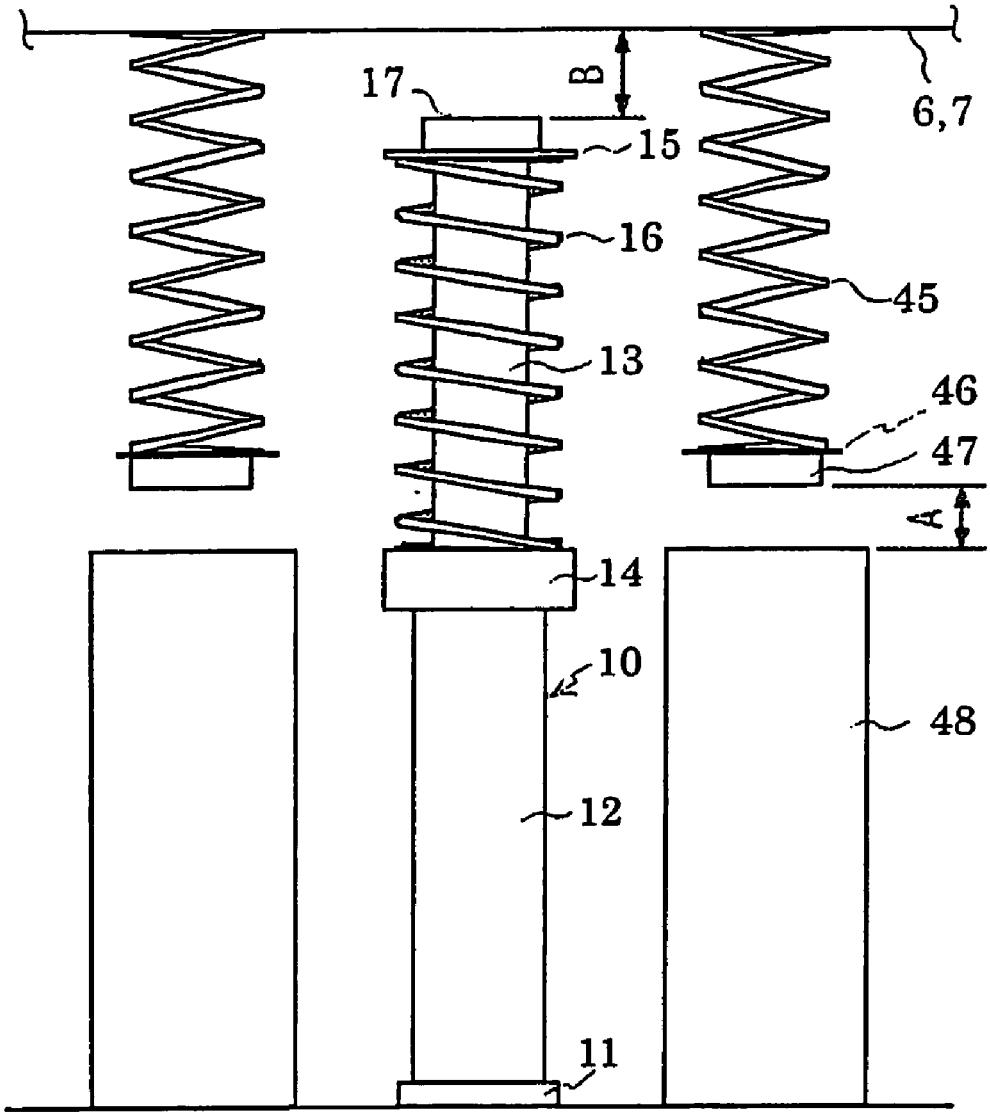
FIG. 7 is a front view showing a buffer device for an elevator according to a fifth embodiment of the present invention.

FIG. 7 is a front view showing a buffer device for an elevator according to a fifth embodiment of the present invention. In this embodiment, on the lower end portion of the car 6 or the counterweight 7, there are fixed two parallel springs 45. On the lower end portion of each parallel spring 45, there are fixed a movable spring bracket 46 and a buffer member 47. On a hoistway pit, two strike bases 48, against which the buffer member 47 strikes, are provided so as to stand thereon. The strike bases 48 are respectively arranged on the sides of the hydraulic buffer 10 in a symmetric manner.

The stiffness of the two parallel springs 45 is set lower than the stiffness of the buffer member 17. Also, under a state where the car 6 or the counterweight 7 does not yet collide with the buffer device, a distance A between the buffer members 47 and the strike bases 48 is set shorter than a distance B between the car 6 or the counterweight 7 and the upper end portion of the hydraulic buffer 10 ($A<B$). With this construction, the parallel springs 45 are compressed prior to the hydraulic buffer 10.

Even with the buffer device like this, it becomes possible to reduce shock and noise generated when the car 6 or the counterweight 7 impacts the hydraulic buffer 10 using the deformation of the parallel spring 45. In addition, it is unnecessary to increase the pit depth.

Sixth Embodiment

Figure 8:
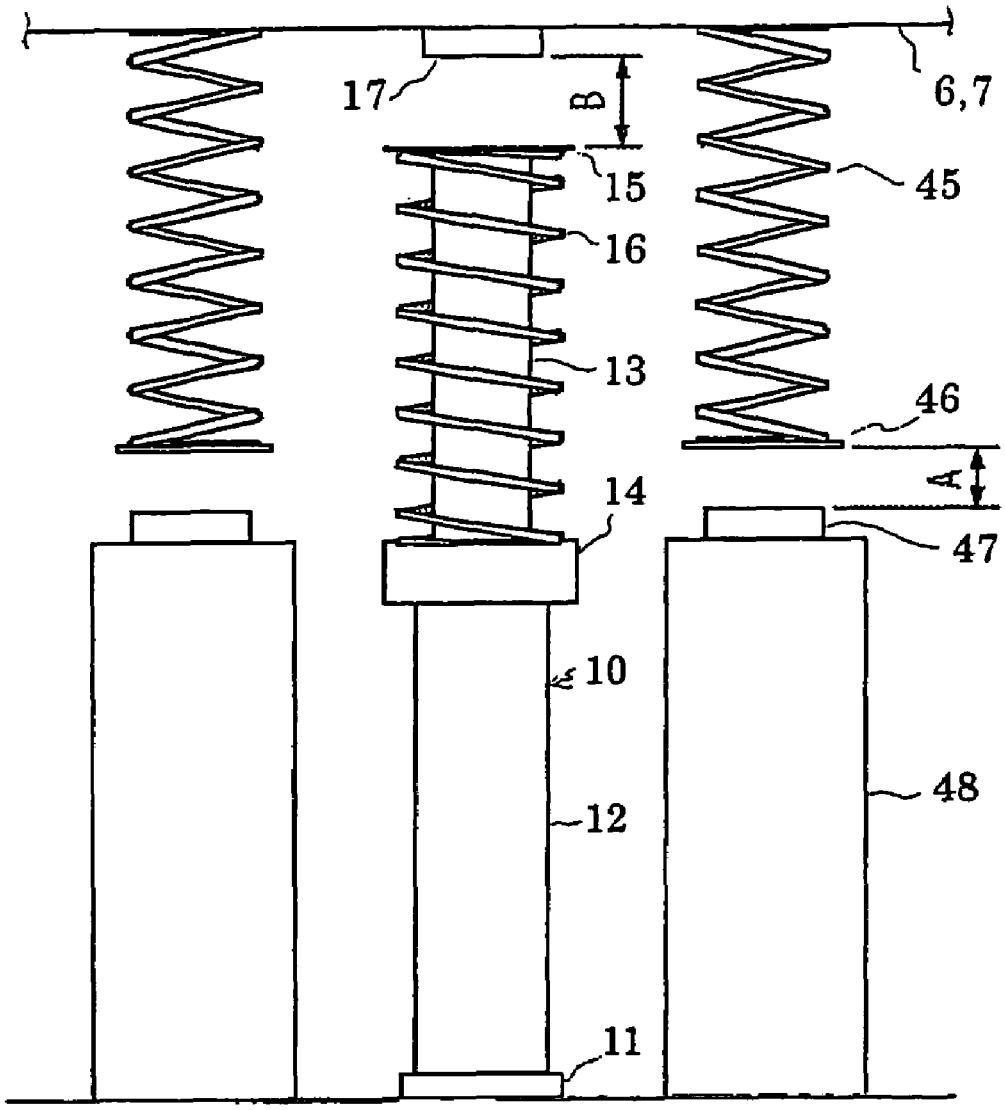
FIG. 8 is a front view showing a buffer device for an elevator according to a sixth embodiment of the present invention.

FIG. 8 is a front view showing a buffer device for an elevator according to a sixth embodiment of the present invention. In this embodiment, a buffer member 17 is attached to the car 6 or the counterweight 7 and two buffer members 47 are respectively attached to the strike bases 48. Other constructions are the same as those in the fifth embodiment. Even with the buffer device like this, it is possible to reduce, without increasing the pit depth, the shock and noise generated when the car 6 or the counterweight 7 impacts the hydraulic buffer 10.

Seventh Embodiment

Figure 9:
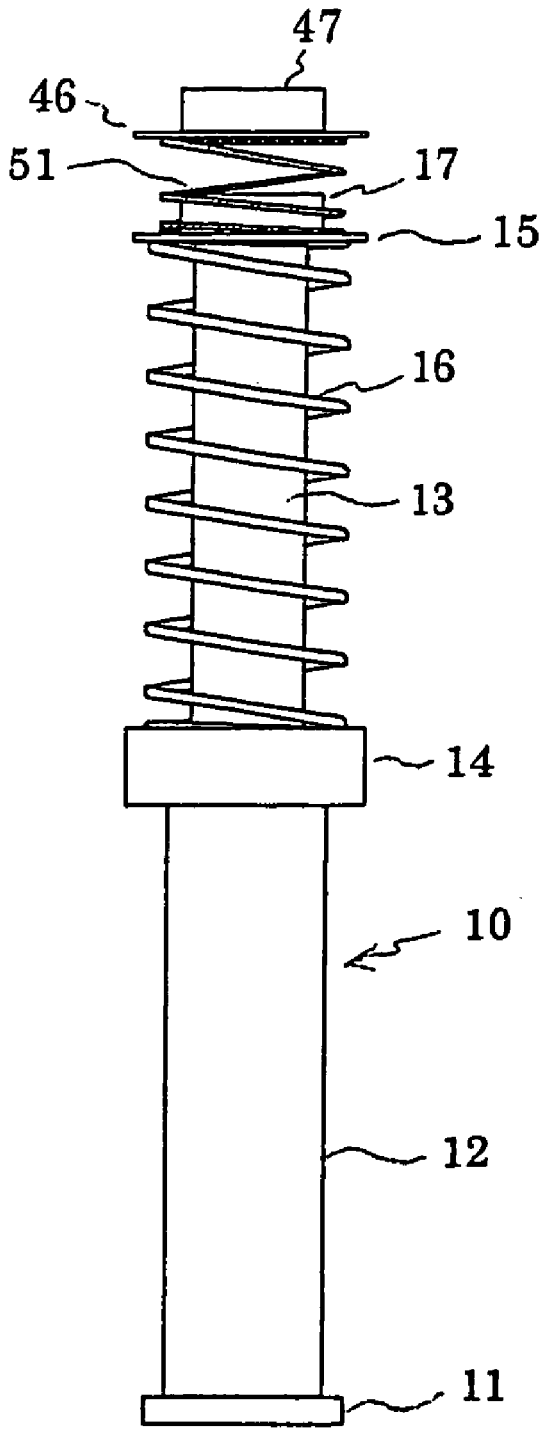
FIG. 9 is a front view showing a buffer device for an elevator according to a seventh embodiment of the present invention.

FIG. 9 is a front view showing a buffer device for an elevator according to a seventh embodiment of the present invention. In this drawing, on the spring bracket 15, a series spring (in-line spring) 51 is mounted as an elastic member. This series spring 51 is arranged in series to the hydraulic buffer 10. Also, the upper end portion of the series spring 51 is positioned higher than the upper end portion of the hydraulic buffer 10. Further, the stiffness of the series spring 51 is set lower than the stiffness of the buffer member 17. Still further, the series spring 51 is constructed so as not to exceed its elastic region even when the car 6 or the counterweight 7 impacts the hydraulic buffer 10 and the series spring 51 is compressed.

On the upper end portion of the series spring 51, there is horizontally fixed a flat-plate-shaped movable spring bracket 46 that is to be vertically moved by expansion and contraction of the series spring 51. The movable spring bracket 46 is positioned higher than the upper end portion of the hydraulic buffer 10. On the movable spring bracket 46, there is fixed a buffer member 47.

Next, there will be described an operation in this embodiment. When the car 6 or the counterweight 7 impacts the buffer device, the lower portion of the car 6 or the counterweight 7 first strikes against the buffer member 47, so that the buffer member 47 is elastically deformed. Following this, the buffer member 47 and the movable spring bracket 46 are pushed down, so that the series spring 51 is compressed (elastically deformed).

Shock energy immediately after the impact of the car 6 or the counterweight 7 is absorbed by the minute deformation of the buffer member 47 and the deformation of the series spring 51, so that impact noise is also reduced. Following this, the plunger 13 is displaced downward and hydraulic braking is applied by the hydraulic buffer 10. As a result, the car 6 or the counterweight 7 is decelerated and stopped with safety.

With a buffer device like this, it becomes possible to reduce shock and noise generated when the car 6 or the counterweight 7 impacts the hydraulic buffer 10 using the deformation of the series spring 51. Also, the shock energy is absorbed by the series spring 51, so that it becomes possible to reduce the thickness of the buffer member 17 in comparison with the conventional case. As a result, it also becomes possible to set the total thickness of the two buffer members 17 and 47 as equal to or less than the thickness of one conventional buffer member. Accordingly, under a state where the buffer device is compressed, the height of the hydraulic buffer 10 becomes larger by only the thickness of the movable spring bracket 46, so that it is unnecessary to increase the pit depth.

In the seventh embodiment, for the same reason as in the first embodiment, it is suitable that a non-linear spring having the spring constant shown in FIG. 3 is used as the series spring 51. This non-linear coil spring is obtained by, for instance, successively changing the diameter of a wire constituting the coil in a tapered manner or making the inter-wire pitch of the coil spring uneven.

It should be noted here that at least one of the buffer members 17 and 47 may be omitted.

Eighth Embodiment

Figure 10:
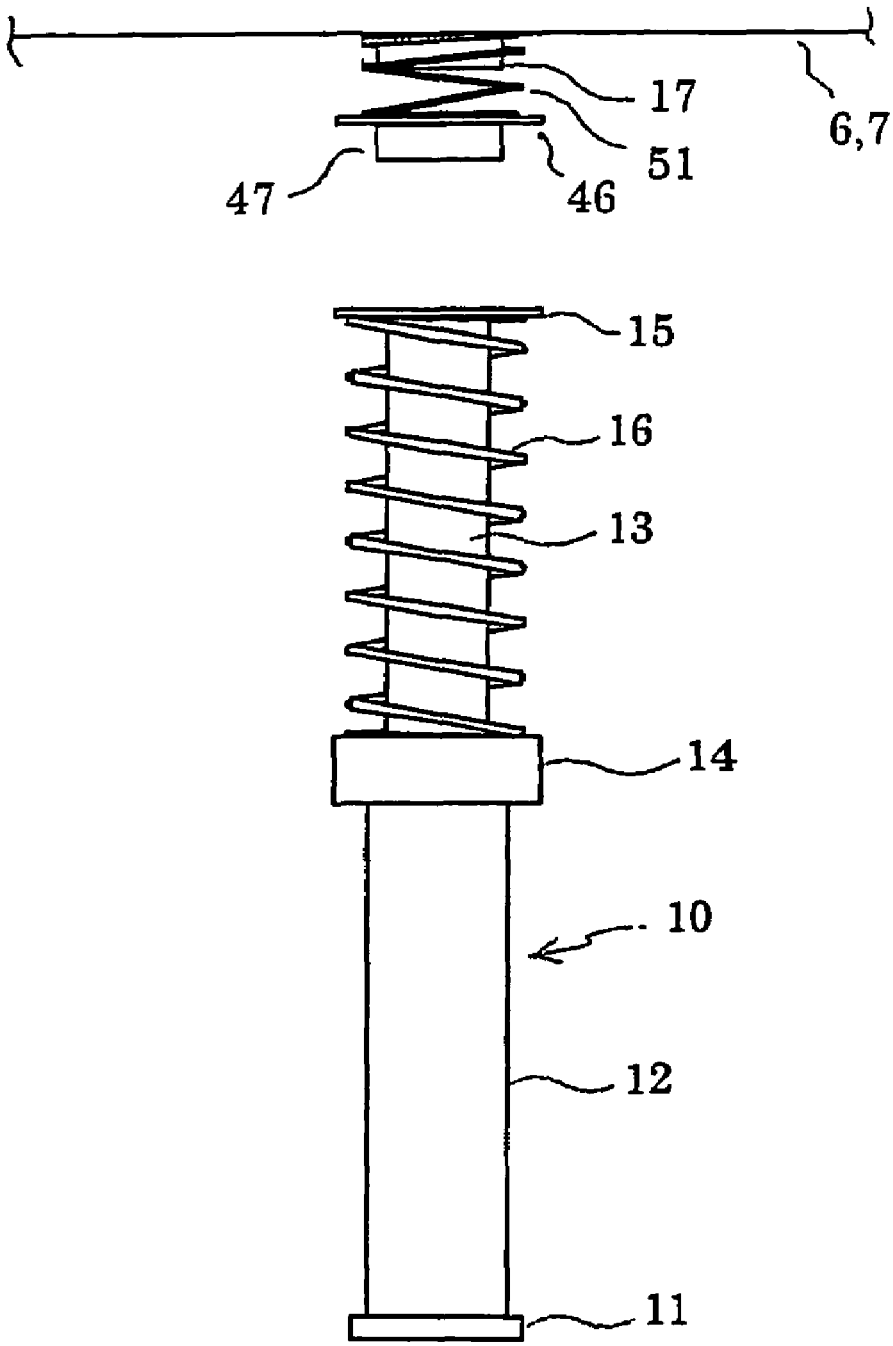
FIG. 10 is a front view showing a buffer device for an elevator according to an eighth embodiment of the present invention.

FIG. 10 is a front view showing a buffer device for an elevator according to an eighth embodiment of the present invention. In this embodiment, the buffer members 17 and 47, the series spring 51, and the movable spring bracket 46 are provided for the car 6 or the counterweight 7. Other constructions are the same as those in the seventh embodiment.

Even with the buffer device like this, it becomes possible to reduce shock and noise generated when the car 6 or the counterweight 7 impacts the hydraulic buffer 10 using the deformation of the series spring 51. In addition, it is unnecessary to increase the pit depth.

Ninth Embodiment

Figure 11:
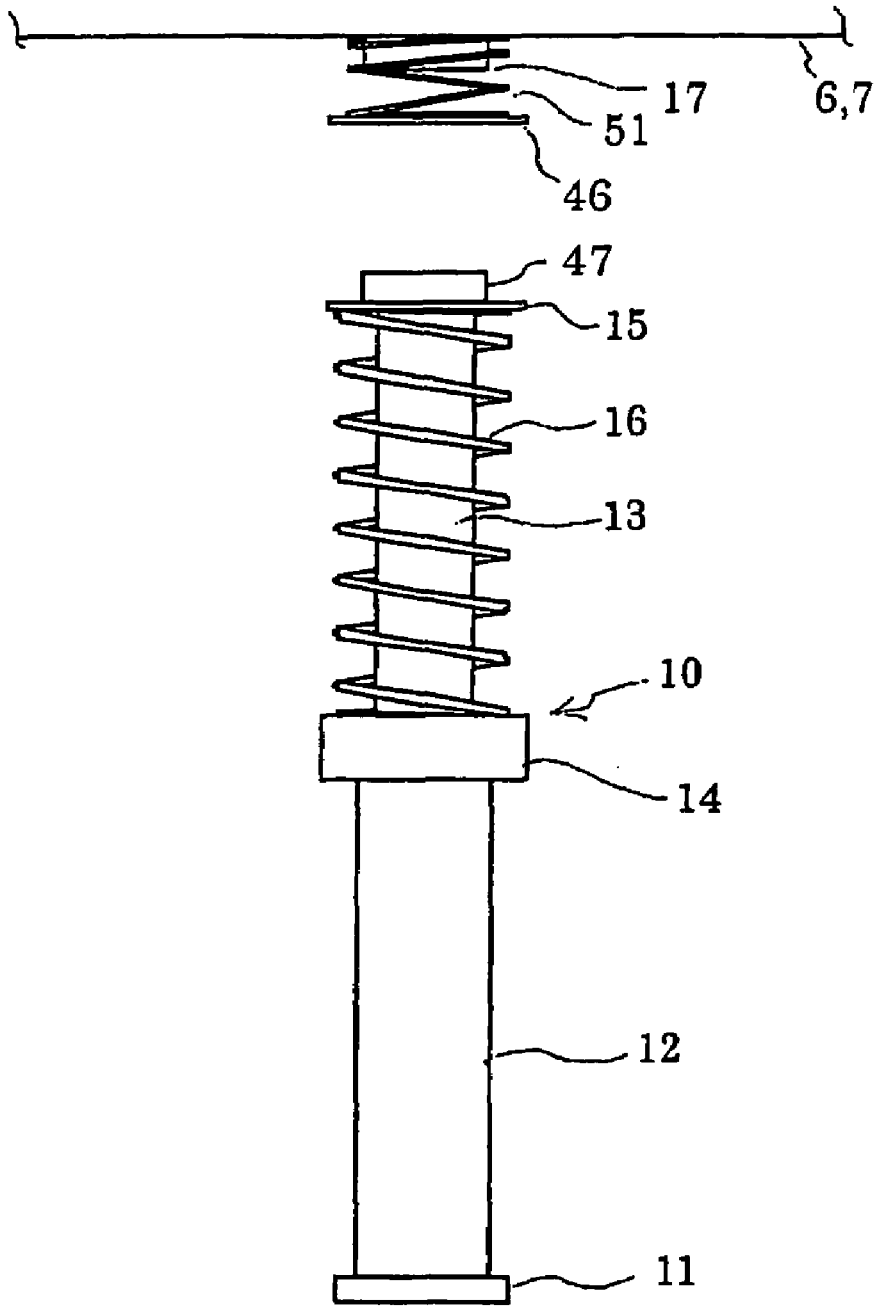
FIG. 11 is a front view showing a buffer device for an elevator according to a ninth embodiment of the present invention.

FIG. 11 is a front view showing a buffer device for an elevator according to a ninth embodiment of the present invention. In this embodiment, the buffer member 17, the series spring 51, and the movable spring bracket 46 are provided for the car 6 or the counterweight 7, and the buffer member 47 is fixed on the spring bracket 15 of the hydraulic buffer 10. Other constructions are the same as those in the eighth embodiment.

Even with the buffer device like this, it becomes possible to reduce shock and noise generated when the car 6 or the counterweight 7 impacts the hydraulic buffer 10 using the deformation of the series spring 51. In addition, it is unnecessary to increase the pit depth.

Tenth Embodiment

Figure 12:
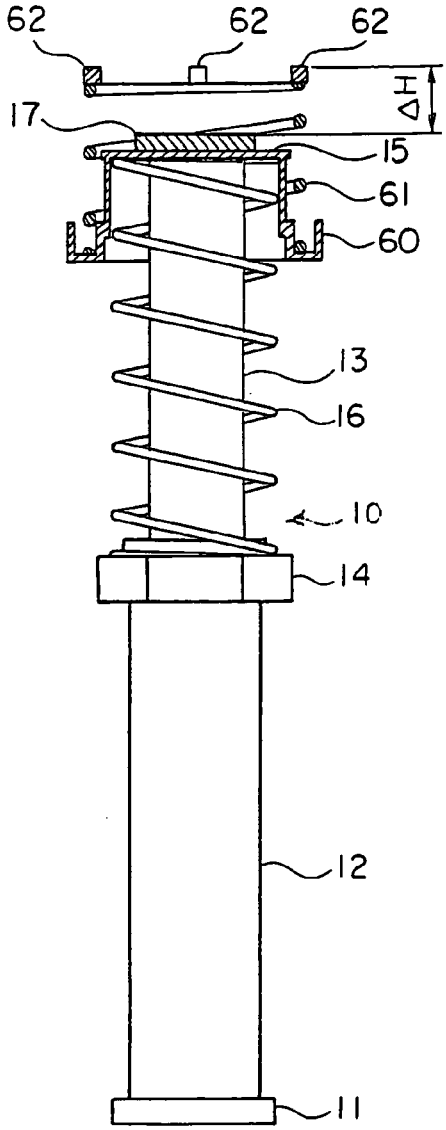
FIG. 12 is a front view showing a buffer device for an elevator according to a tenth embodiment of the present invention.
Figure 13:
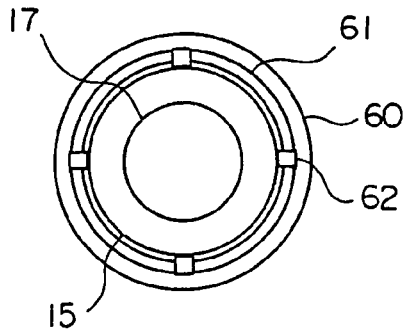
FIG. 13 is a top view showing the buffer device in FIG. 12.

FIG. 12 is a front view showing a buffer device for an elevator according to a tenth embodiment of the present invention, while FIG. 13 is a top view showing the buffer device in FIG. 12. In these drawings, a spring supporting portion 60 is integrally provided for the spring bracket 15. That is, the spring bracket 15 and the spring supporting portion 60 constitute together a hat-shaped component. The inside diameter of the spring supporting portion 60 is set larger than the outside diameters of the return spring 16 and the flange 14.

A coil spring 61 is supported as an elastic member by the spring supporting portion 60. The lower end portion of the coil spring 61 is positioned lower than the upper end portion of the return spring 16, that is, the upper end portion of the plunger 13, and the upper end portion (free end) of the coil spring 61 is positioned higher than the upper end portion of the plunger 13. The upper end portion of the coil spring 61 at the time of non-compression protrudes upward with reference to the upper end portion of the buffer member 17 by ΔH.

The buffer member 17 is made of rubber, for instance. The spring constant of the coil spring 61 is set smaller than the spring constant of the buffer member 17. In the upper end portion of the coil spring 61, a plurality of auxiliary buffer members 62 are fixed so as to be evenly spaced in the circumferential direction of the coil spring 61. Note that in this drawing, the spring bracket 15, the spring supporting portion 60, the coil spring 61, and the auxiliary buffer member 62 are illustrated using their cross sections.

Figure 14:
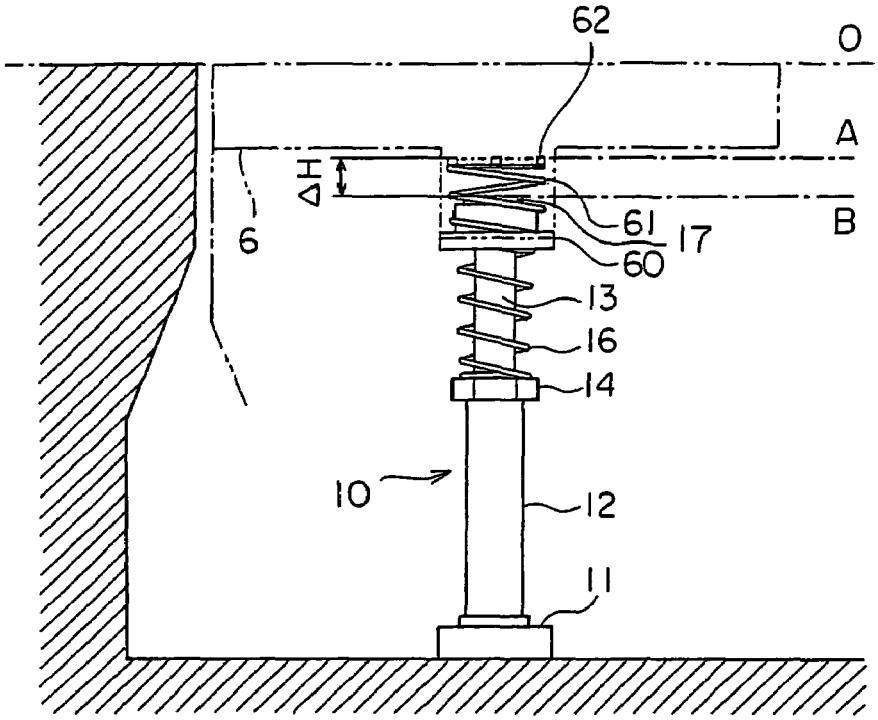
FIG. 14 is a front view showing a state of the buffer device in FIG. 12 at the time of no load.
Figure 15:
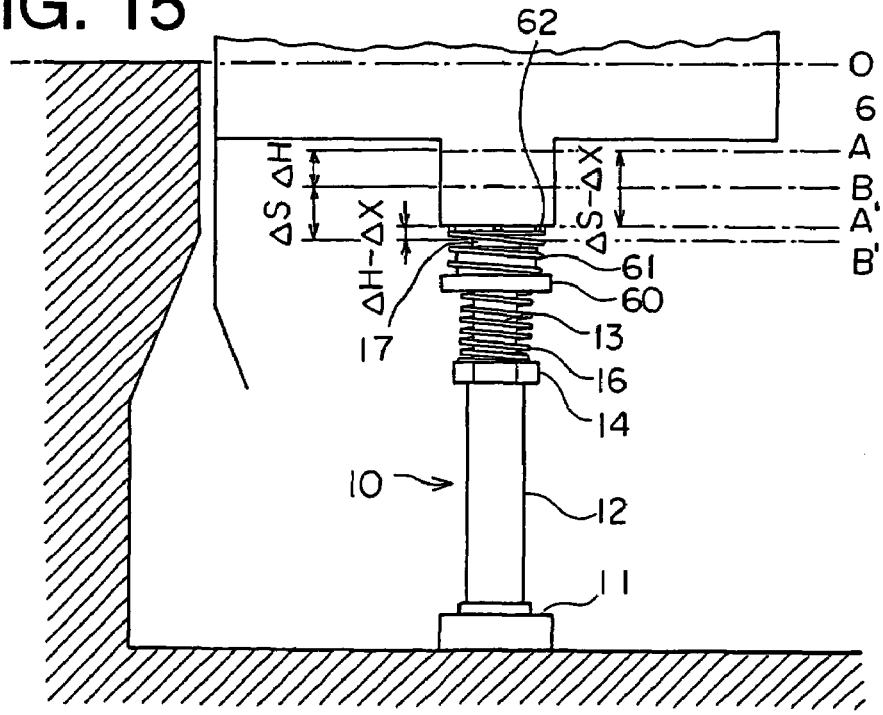
FIG. 15 is a front view showing a compressed state of the buffer device in FIG. 12 at the time of landing at the lowest floor.
Figure 16:
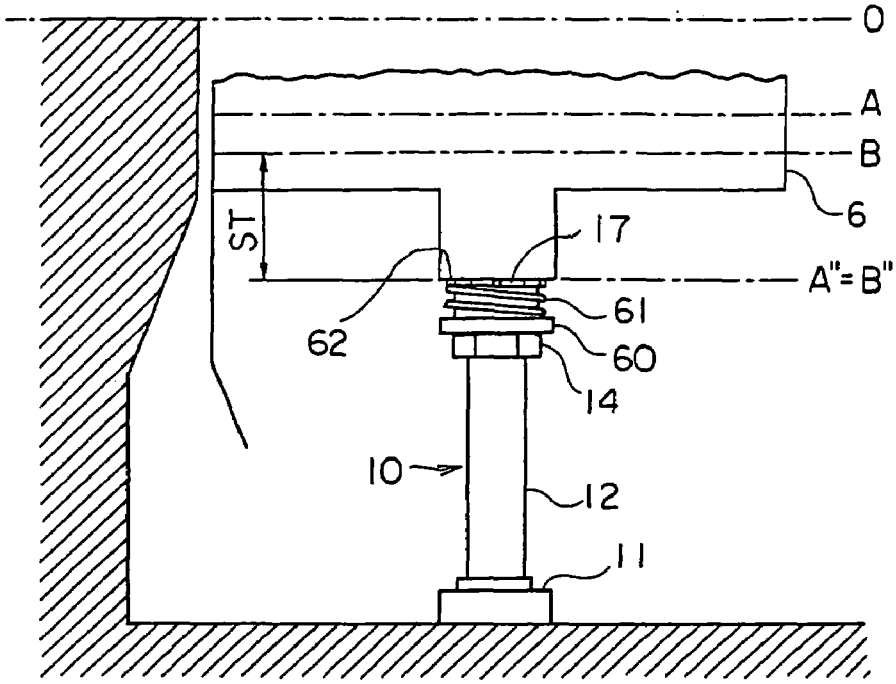
FIG. 16 is a front view showing a state of the buffer device in FIG. 12 at the time of full compression.

FIG. 14 is a front view showing a state of the buffer device in FIG. 12 at the time of no load, FIG. 15 is a front view showing a compressed state of the buffer device in FIG. 12 at the time of landing at the lowest floor, and FIG. 16 is a front view showing a state of the buffer device in FIG. 12 at the time of full-compression. In this embodiment, the buffer device is installed so that when the car 6 lands at the lowest floor during normal operation, this buffer device is compressed in a normal manner, as shown in FIG. 15. That is, the hydraulic buffer 10 is arranged within the traveling path of the traveling body at the time of normal operation.

Also, in FIG. 14, the floor height of the lowest floor (upper end of the pit) is indicated using reference letter "O", the height of the upper end portion of the buffer device (upper end portion of the auxiliary buffer member 62) at the time of no load is indicated using reference letter "A", and the height of the upper end portion of the buffer member 17 at the time of no load is indicated using reference letter "B". Further, in FIG. 15, the height of the upper end portion of the buffer device at the time of landing at the lowest floor is indicated using reference letter "A'", while the height of the upper end portion of the buffer member 17 at the time of landing at the lowest floor is indicated using reference letter "B'". Still further, in FIG. 16, the height of the upper end portion of the buffer device at the time of full-compression is indicated using reference letter "A"", the height of the upper end portion of the buffer member 17 at the time of full-compression is indicated using reference letter "B"", and the whole stroke is indicated using reference letters "ST". At the time of full-compression, the whole of the coil spring 61 is positioned within the range of the dimension in a vertical direction of the hydraulic buffer 10.

In order to completely return the plunger 13 to its original position after compression, the return spring 16 is initially compressed by the spring bracket 15 with reference to its natural length even under a no-loaded condition. That is, under a no-loaded condition, the return spring 16 possesses an initial compressive force F0. As a matter of course, this initial compressive force F0 is set larger than the mass Mp of the plunger 13 ($Mp \times g \leqq F0$).

Accordingly, in the case where a stroke compressed at the time of landing at the lowest floor is referred to as ΔS and the protrusion amount ΔH of the coil spring 61 from the upper end portion of the buffer member 17 is assumed constant, the force equilibrium at the time when the car 6 lands at the lowest floor and the coil spring 61 is compressed by ΔX (state shown in FIG. 15) is expressed by the expression given below by assuming that static equilibrium is achieved and by disregarding the hydraulic pressure within the cylinder 12:

$$Mp \times g + Kc \times \Delta X = Kr + \Delta S + F0 \quad \text{(Expression 1)}$$

Here, "g" is gravitational acceleration, "Kc" is the spring constant of the coil spring 61, and "Kr" is the spring constant of the return spring 16.

Figure 17:
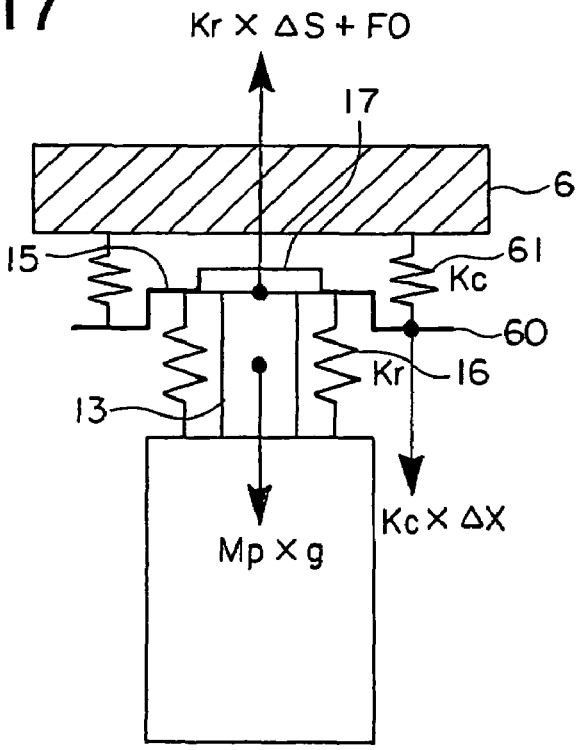
FIG. 17 is an explanatory drawing that shows a force equilibrium state of the buffer device in FIG. 15 in a simplified manner.

Also, FIG. 17 is an explanatory drawing showing a force equilibrium state of the buffer device in FIG. 15 in a simplified manner. The compression amount Δx of the coil spring 61 must be smaller than the protrusion amount ΔH under the no-load condition ($\Delta X \leqq \Delta H$), so that the following expression is obtained with regard to the spring constant of the coil spring 61.

$$Kc \geqq (Kr \times \Delta S + F0 - Mp \times g)/\Delta H \quad \text{(Expression 2)}$$

As described above, since "Mp×g≦F0" is established, it is possible to rewrite Expression 2 into the expression given below.

$$Kc>Kr\times\Delta S/\Delta H \quad \text{(Expression 3)}$$

The lowest floor landing position of the car 6 is lowered from the position of the upper end portion of the buffer device (upper end portion of the auxiliary buffer member 62) at the time of no load by ΔS+ΔX.

With such a construction, when the car 6 lands at the lowest floor at the time of normal operation, it becomes possible to partially compress the stroke of the hydraulic buffer 10 while preventing a situation where the car 6 directly contacts the buffer member 17. That is, the stiffness of the coil spring 61 is set so that when the car 6 moves to the lowest position in a normal traveling path, the hydraulic buffer 10 is compressed through the coil spring 61 under a state where a space remains between the hydraulic buffer 10 and the car 6. As a result, it becomes possible to effectively reduce vibration and noise at the time of landing at the lowest floor.

Also, even at the time of full-compression, the coil spring 61 is not compressed so as to exceed ΔH, and the height of the buffer device at the time of full-compression does not differ from that in the case where the coil spring 61 is not mounted. As a result, no influence is exerted on the pit depth.

Further, the spring constant of the coil spring 61 is set smaller than the spring constant of the buffer member 17 and the coil spring 61 is compressed only by a part of its elastic region even if the hydraulic buffer 10 is fully compressed, so that it becomes possible to reduce an influence exerted on a deceleration characteristic of the hydraulic buffer 10 in an emergency.

It should be noted here that the buffer device in the tenth embodiment may be applied to a counterweight buffer.

Also, in the tenth embodiment, the lower end portion of the coil spring 61 is fixed on the spring supporting portion 60. However, the upper end portion of the coil spring 61 may be fixed on the lower end portion of the traveling body and the lower end portion of the coil spring may be a free end. In this case, the lower end portion of the coil spring is abutted against the spring supporting portion at the time of landing at the lowest floor.

Further, in the first to tenth embodiments, the elastic members are the leaf spring 41, the parallel spring 45, the series spring 51, and the coil spring 61. However, rubber springs, air springs, wire springs, or the like, for instance, may be used instead.

Still further, with the buffer device of the present invention, it becomes possible to reduce the shock and noise generated at the time of impact of the car or the counterweight with the hydraulic buffer. Therefore, the present invention is particularly effective in the case of an elevator of the type described above, in which when moving to the lowest floor during normal operation, the car impacts the hydraulic buffer. This is because it becomes possible to improve riding comfort by reducing shock and noise at the time of normal operation.

Also, in the first to third embodiments and the seventh to ninth embodiments, it becomes possible to provide the same effects by setting the spring constant of the leaf spring or the series spring in the same manner.

Further, although it was explained in the first to tenth embodiments, cases where the hydraulic buffer is installed at the bottom of the hoistway, it is also possible to mount the hydraulic buffer in the lower portion of the traveling body.

What is claimed is:

1. A buffer device for an elevator apparatus, comprising:

a hydraulic buffer that alleviates shock generated when a traveling body of the elevator apparatus impacts the hydraulic buffer, the hydraulic buffer including a cylinder, a plunger at least partially within the cylinder and reciprocating along an axial direction of the cylinder, and a return spring having upper and lower ends and urging the plunger along the axial direction, outward from the cylinder, the upper end of the return spring being directed toward the plunger and the lower end being directed toward the cylinder; and an elastic member located between the traveling body of the elevator apparatus and the bottom of a hoistway in which the traveling body of the elevator apparatus moves, to alleviate shock generated by impact of the traveling body of the elevator apparatus with the hydraulic buffer, wherein the elastic member includes a coil spring having upper and lower ends and that is arranged to act mechanically in series with the hydraulic buffer, when the coil spring is elastically compressed, almost all of the coil spring, between the upper and lower ends of the coil spring, is within a vertical dimension of the hydraulic buffer along the axial direction, and the lower end of the coil spring is located lower in the hoistway than is the upper end of the return spring and transmits a compressive force applied to the coil spring to the plunger of the hydraulic cylinder.

2. The buffer device for an elevator apparatus according to claim 1, further comprising a spring supporting portion mounted on an end of the plunger, wherein the return spring bears upon the spring supporting portion, urging the plunger outward, the lower end of the coil spring is supported by the spring supporting portion, surrounding a part of the plunger, and the upper end of the coil spring extends beyond the end of the plunger.

3. The buffer device for an elevator apparatus according to claim 1, wherein the coil spring has a spring constant Kc, the return spring has a spring constant Kr, the coil spring extends upward beyond the plunger by a distance ΔH when no load is applied to the coil spring, the traveling body compresses the coil spring by a distance ΔS when reaching the bottom of the hoistway, and Kc>Kr×ΔS/ΔH.

* * * * *